US007741975B2

(12) United States Patent
Shum et al.

(10) Patent No.: US 7,741,975 B2
(45) Date of Patent: Jun. 22, 2010

(54) AUDIBLE CONTENT WITH TRAINING INFORMATION

(75) Inventors: Albert Shum, Portland, OR (US); Gregory Vissia, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 10 days.

(21) Appl. No.: 11/142,835

(22) Filed: May 31, 2005

(65) Prior Publication Data

US 2005/0266961 A1 Dec. 1, 2005

Related U.S. Application Data

(60) Provisional application No. 60/576,184, filed on May 31, 2004.

(51) Int. Cl.
*G08B 25/08* (2006.01)

(52) U.S. Cl. ..... 340/692; 340/539.1; 340/573.1; 482/3; 702/182

(58) Field of Classification Search ..... 340/539.1, 340/539.11, 539.12, 692, 573.1; 482/3, 8–9; 377/24.2; 702/182
See application file for complete search history.

(56) References Cited

U.S. PATENT DOCUMENTS

| | | | | |
|---|---|---|---|---|
| 5,314,389 | A | 5/1994 | Dotan | |
| 6,013,007 | A | 1/2000 | Root et al. | |
| 6,716,139 | B1 | 4/2004 | Hosseinzadeh-Dolkhani et al. | |
| 6,837,827 | B1 * | 1/2005 | Lee et al. | 482/8 |
| 7,062,225 | B2 | 6/2006 | White | |
| 7,251,454 | B2 | 7/2007 | White | |
| 7,519,327 | B2 | 4/2009 | White | |
| 2002/0115937 | A1 | 4/2002 | Song | |
| 2005/0049113 | A1 * | 3/2005 | Yueh et al. | 482/8 |
| 2005/0195094 | A1 * | 9/2005 | White | 340/870.01 |

FOREIGN PATENT DOCUMENTS

| | | | |
|---|---|---|---|
| EP | 1 128 358 | A1 | 8/2001 |
| JP | 2001101573 | A | 4/2001 |
| JP | 2001299980 | A | 10/2001 |
| JP | 2002507734 | T | 3/2002 |
| JP | 2009206417 | A | 9/2009 |
| WO | 9949279 | A1 | 9/1999 |
| WO | WO 02/067449 | A2 | 8/2002 |

OTHER PUBLICATIONS

Communication pursuant to Article 94(3) EPC, European Application No. 05756510.3-1260, mailed Oct. 20, 2009, 3 pages.
Notification of Reasons for Refusal for Japanese Patent Application No. 2007-515511 mailed Feb. 25, 2010, 5 pages.

* cited by examiner

*Primary Examiner*—Benjamin C Lee
*Assistant Examiner*—Samuel J Walk
(74) *Attorney, Agent, or Firm*—Banner & Witcoff, Ltd.

(57) ABSTRACT

An audible playback device that allows an athlete, such as a runner, to conveniently listen to audible content and receive athletic performance information. A single device may be employed to both playback audible content and provide monitored performance information to a user. The performance information may be provided to a user audibly, so that the user does not need to move the monitoring device's user interface to a viewable position.

24 Claims, 6 Drawing Sheets

AUDIBLE CONTENT WITH TRAINING INFORMATION

RELATED APPLICATIONS

This Application is a continuation-in-part of Provisional U.S. Patent Application No. 60/576,184, entitled "Audible Content with Training Information" filed on May 31, 2004, and naming Albert Shum, et al. as inventors, which application is incorporated entirely herein by reference.

FIELD OF THE INVENTION

The invention relates to providing training information with audible content. More particularly, various embodiments of the invention relate to a device that plays back audible content for a user, while periodically providing the user with training information.

BACKGROUND OF THE INVENTION

To measure their performance in a quantifiable manner, athletes will often measure various performance characteristics corresponding to their activities. For example, a runner may measure a total distance traveled during a run, a total elapsed time required to run a distance, the elapsed time required to run a segment of the distance, and/or the average time required to run equal segments of the distance. Likewise, cyclists, ice skaters, sailors, hikers, swimmers, skiers, and other athletes may desire to measure the total distance traveled, a total elapsed time required to travel a distance, the elapsed time required to run a segment of the distance, and/or the average time required to run equal segments of the distance.

In addition to (or instead of) measuring temporal and positional information, some athletes will measure their biometric information. For example, during an activity, an athlete may employ a heart-rate monitor to monitor his or her heart rate, a thermostat to measure the athlete's body temperature, a blood pressure monitor to measure the athlete's blood pressure, a volumetric expansion monitor to monitor the expansion of the athlete's lungs while performing an activity, an oxygen content meter to measure the amount of oxygen in the athlete's bloodstream (e.g., by measuring the amount of oxygen in the athlete's exhaled breath), or even more sophisticated biometric monitoring device, such as an ECG (electrocardiogram) monitor. The athlete can then use this biometric information to analyze his or her athletic performance.

Many athletes also prefer to use some type of audible playback device during an athletic activity. For example, many athletes will listen to music or other audible content transmitted over radio waves, decoded from an electronically or magnetically stored file (such as an MP3, AAC or WAV files), or decoded from a file stored on an optical medium (such as a compact disc (CD)) during an athletic activity. Some athletes find that the audible content distracts the athlete from the monotony of an athletic activity, while other athletes believe that audible content with rhythm can be used to help the athlete maintain a desired pace. Still other athletes alternately or additionally choose to carry a wireless telephone during their activities, in case they need to be contacted with an important message.

While an athlete may monitor positional, temporal, and/or biometric information during an athletic activity, the athlete will not typically monitor this information continuously. Instead, the athlete will only periodically monitor this information. Accordingly, many athletes use a performance monitoring device in conjunction with an audible content playback device. For example, a runner may listen to an MP3 or WAV file player while wearing a watch wirelessly linked to a pedometer on the runner's foot. In this way, the runner can listen to desired audible content, such as music or a book or magazine article read aloud, while periodically monitoring his or her speed and distance.

While such use of multiple devices does allow an athlete to both enjoy the playback of audible content and monitor performance data, the use of multiple devices may be inconvenient and awkward for the athlete. For example, if an athlete desires to listen to music, receive calls through a wireless telephone, and check performance information, the athlete must physically carry at least three different pieces of equipments. Further, if an athlete is using an MP3 player and receives a call on a wireless telephone, the athlete must remove the headphones for the MP3 player, and break stride by moving the wireless telephone to the athlete's ear. Likewise, if the athlete desires to view performance data, the athlete typically must break stride to move the monitoring device's user interface (e.g., a display on a watch) to a viewable position. Still further, an athlete may find it difficult to concentrate on understanding the performance data while still listening to the audible content.

SUMMARY OF THE INVENTION

The invention advantageously allows an athlete, such as a runner, to conveniently listen to audible content and receive performance information. For example, various embodiments of the invention employ a single device to both playback audible content and provide monitored performance information to a user. Some embodiments of the invention even provide the performance information to a user audibly, so that the user does not need to move the monitoring device's user interface (e.g., a display on a watch) to a viewable position. Instead, the user can simply listen to the performance information rather than (or in addition to) the audible content.

These and other features and aspects of the invention will be apparent upon consideration of the following detailed description of the preferred embodiments.

DETAILED DESCRIPTION OF PREFERRED EMBODIMENTS

Figure 1:
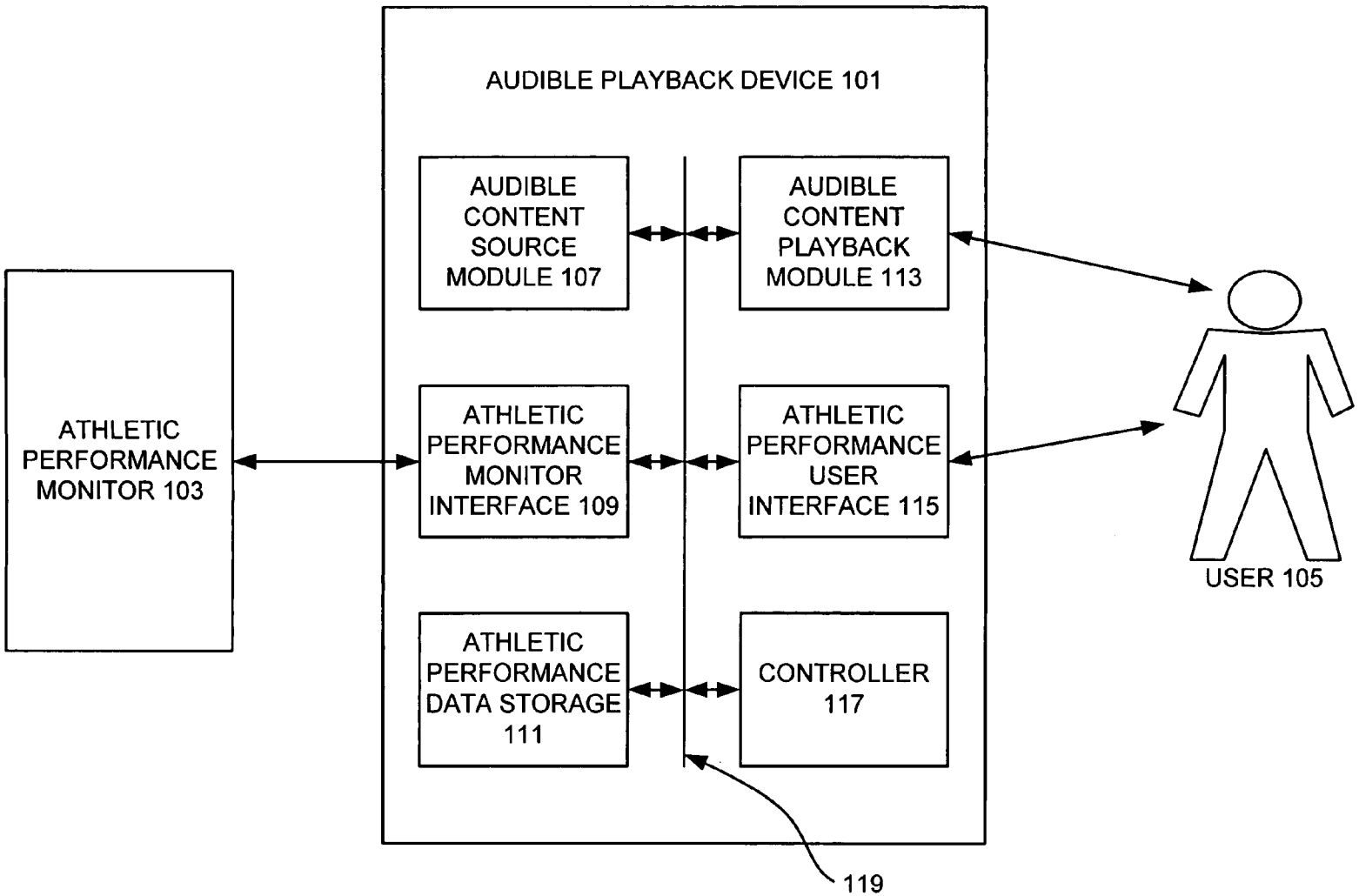
FIG. 1 is a block diagram of components of an audible content playback device according to various embodiments of the invention.

FIG. 1 illustrates an audible playback device 101 according to various embodiments of the invention. As seen in this figure, the audible playback device 101 interacts with an athletic performance monitor 103 in order to provide audible content playback and athletic performance information to a user 105. The audible playback device 101 includes an audible content source module 107, an athletic performance monitor interface 109, an athletic performance data storage 111, an audible content playback module 113, an athletic performance user interface 115, and a controller 117. As will be explained in more detail below, one or more of the components 107-117 may be implemented using programmable electronic circuitry (sometimes referred to as "hardware") together with a set of instructions (sometimes referred to as "software") for controlling the operation of the programmable electronic circuitry. Alternately or additionally, one or more of the components 107-117 may be implemented using non-programmable electronic circuitry, or a combination of the two. For example, the audible content playback module 113 may be implemented using programmable circuitry to deliver electronic signals to a piezoelectric emitter for emitting sounds corresponding to the electronic signals.

The audible content source module 107 may be any device or system for playing back audible content. For example, with some embodiments of the invention, the audible content source module 107 may be a music player for playing back music or voice information, e.g., electronically stored in a music file (such as an MP3, AAC, or WAV file) or retrieved from an optical storage device. Further, the audible content source module 107 may be a radio receiver for receiving and decoding music or voice information transmitted over radio waves. Still further, the audible content source module 107 may include the components of a wireless telephone, for both transmitting and receiving sound information to and from another transceiver device. Moreover, with the still other embodiments of the invention, the audible content source module 107 may include any combination of music player, radio receiver, or mobile telephone transceiver device.

The athletic performance monitor interface 109 communicates with the athletic performance monitor 103. The athletic performance monitor 103 may be any desired type of athletic performance monitor. More particularly, the athletic performance monitor 103 may monitor an athlete's positional information, temporal information, biometric information, or any combination thereof. For example, the athletic performance monitor 103 may include any combination of speedometer or GPS tracking device, chronometer or chronograph, heart rate monitor, blood pressure monitor, lung expansion monitor, oxygen content monitor, or other monitoring device.

With some embodiments of the invention, the athletic performance monitor 103 may be a remote component from the audible playback device 101. For example, with some embodiments of the invention, the athletic performance monitor 103 may be a pedometer or GPS device remotely located from the audible playback device 101. With these embodiments of the invention, the athletic performance monitor 103 may communicate with the athletic performance monitor interface 109 through a wired or wireless connection. The wireless connection may be, for example, over a radio frequency, infrared, visible, or ultrasonic wavelength medium. With still other embodiments of the invention, the athletic performance monitor 103 may be incorporated into the audible playback device 101. For example, if the athletic performance monitor 103 is a chronograph or chronometer, then the athletic performance monitor 103 may be implemented within the audible playback device 101. For still other embodiments of the invention, the athletic performance monitor 103 may include both remotely located and internally located performance monitoring devices.

The athletic performance data storage 111 may be any component for storing athletic performance data provided by the athletic performance monitor 103. For example, the athletic performance data storage 111 may be a solid state storage device, a magnetic storage device, an optical storage device, a punched storage device, or other type of storage device. The audible content playback module 113 may be any type of device for converting audible content information provided by the audible content source module 107 into audible content that may be heard by the user 105. The athletic performance user interface 115 then provides the performance data measured by the athletic performance monitor 103 to the user 105. As will be discussed in more detail, the athletic performance user interface 115 may provide athletic performance data to the user visually, audibly, or as a combination of the two. The control 117 then controls the operation of each of the audible content source module 107, the athletic performance monitor interface 109, the athletic performance data storage 111, the audible content playback module 113, and the athletic performance user interface 115. Each of these components may communicate with each other over a data bus 119.

Figure 2A:
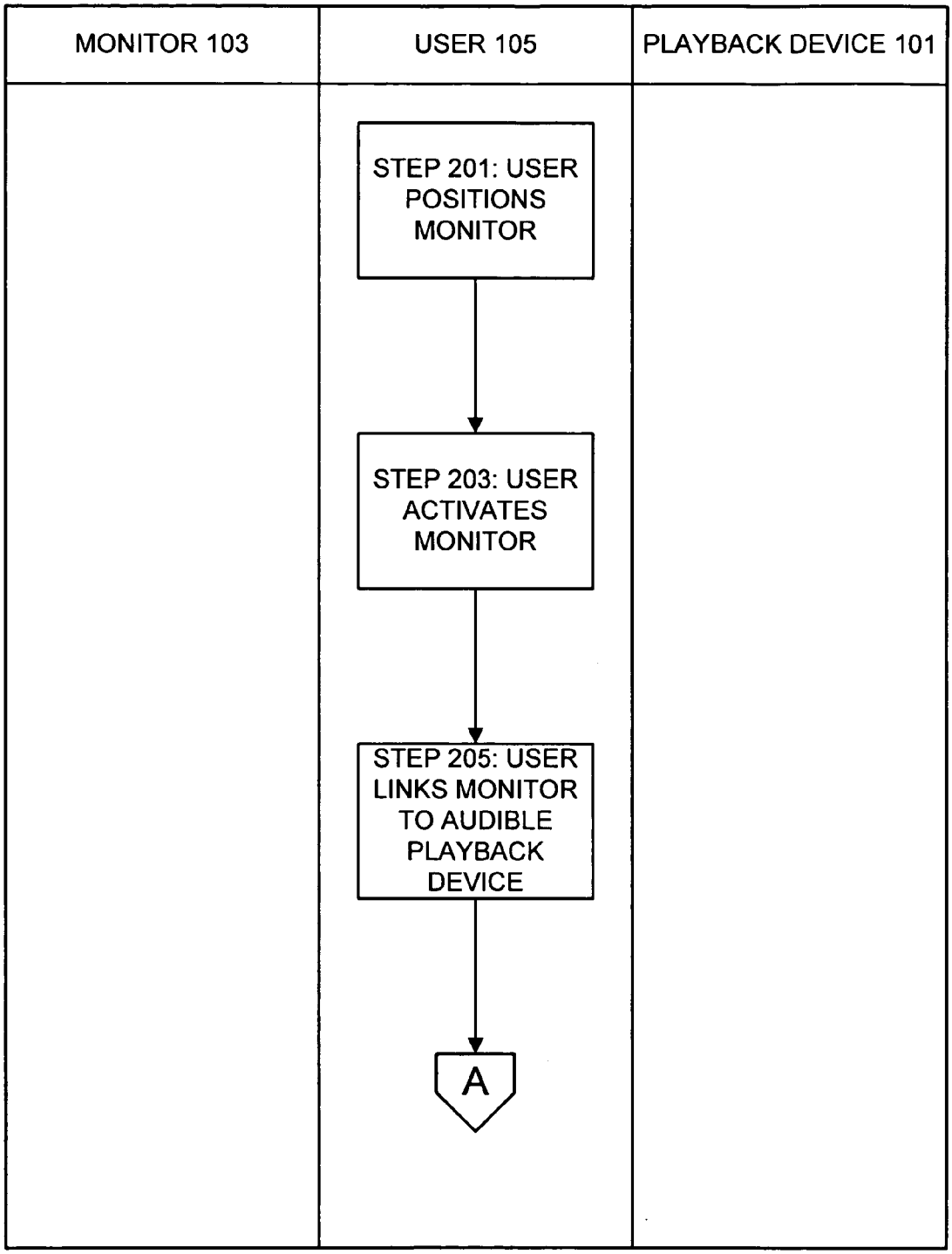
FIGS. 2A-2D illustrate a process by which an audible content playback device can provide a user with both audible content and performance information according to various embodiments of the invention.
Figure 2B:
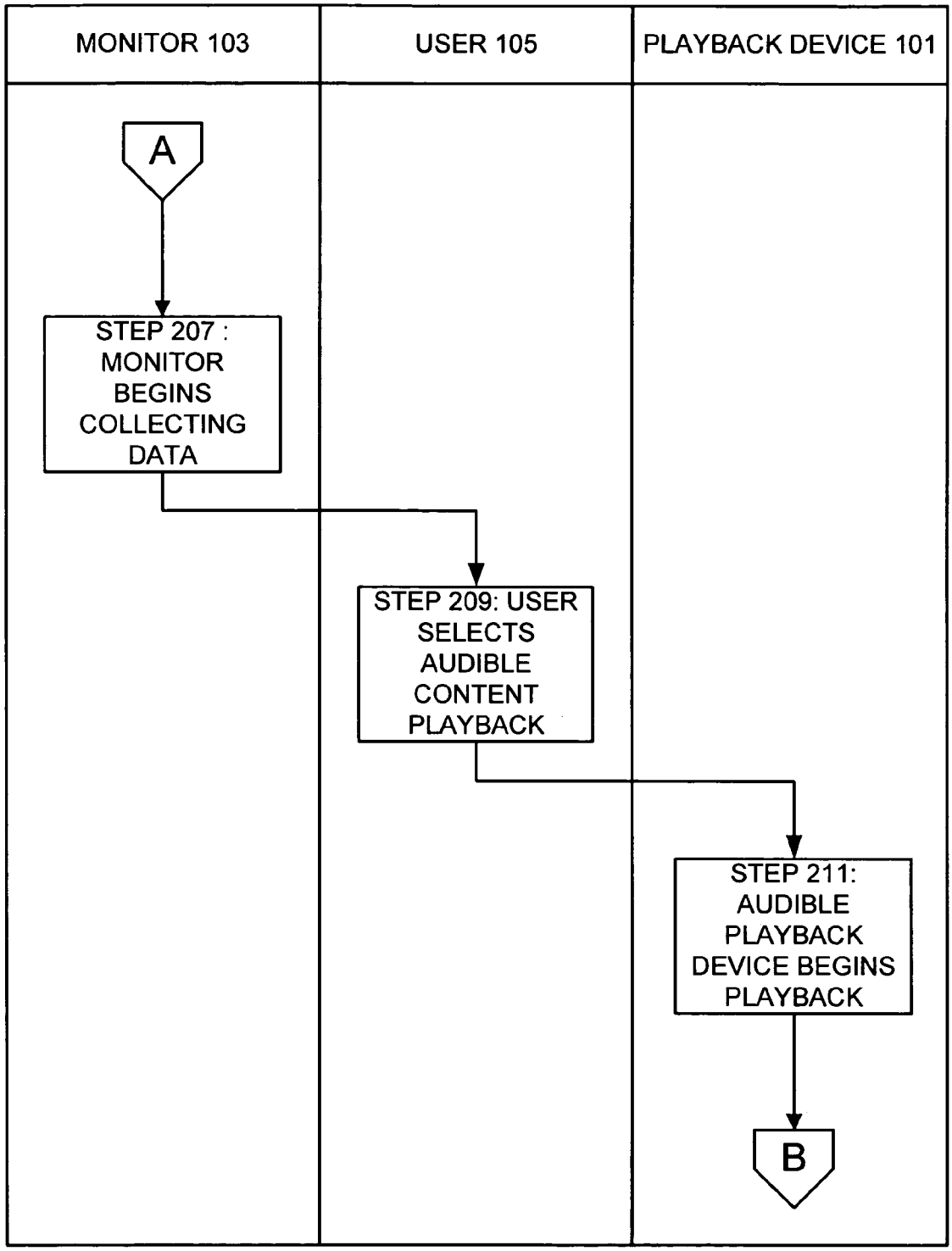
Figure 2C:
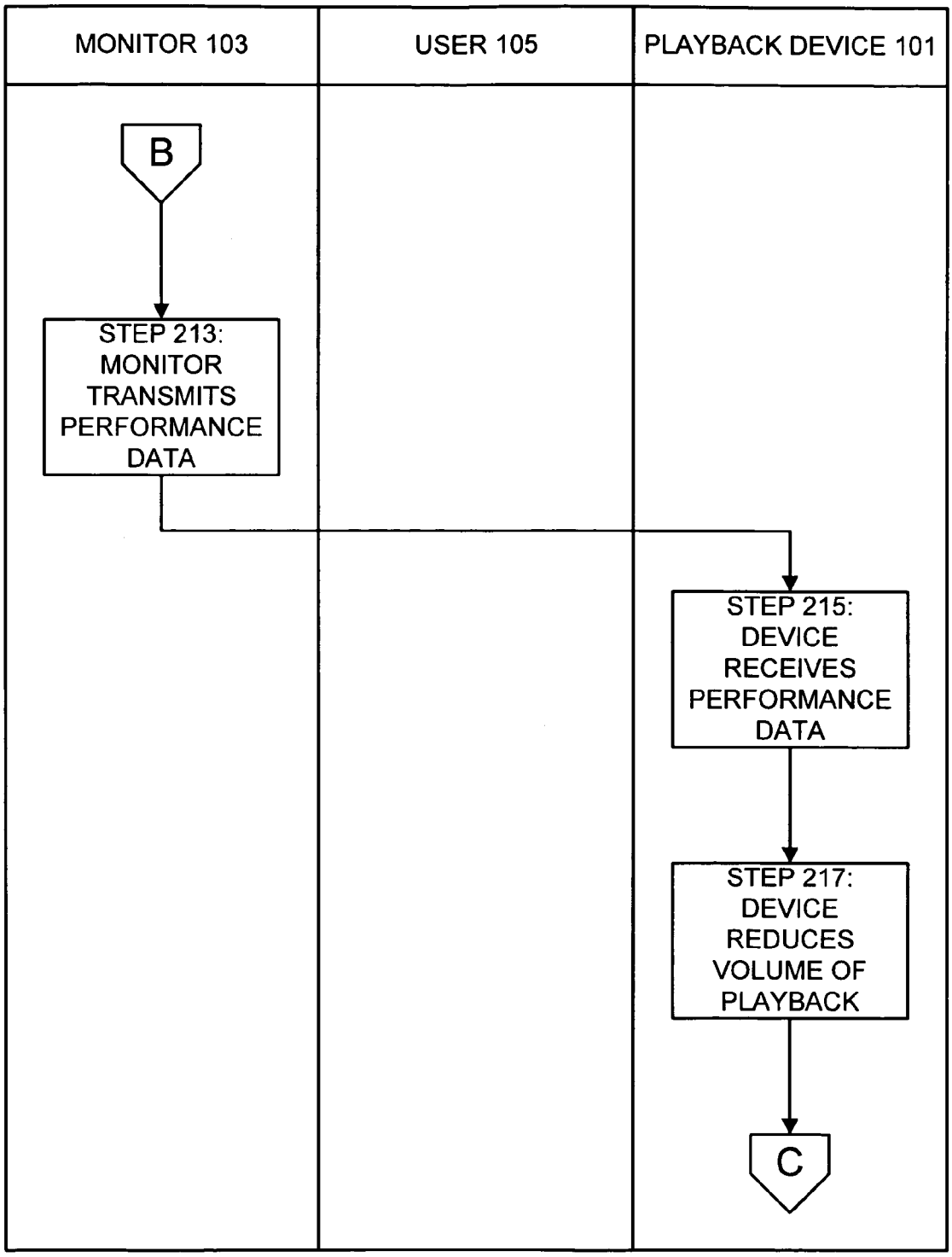
Figure 2D:
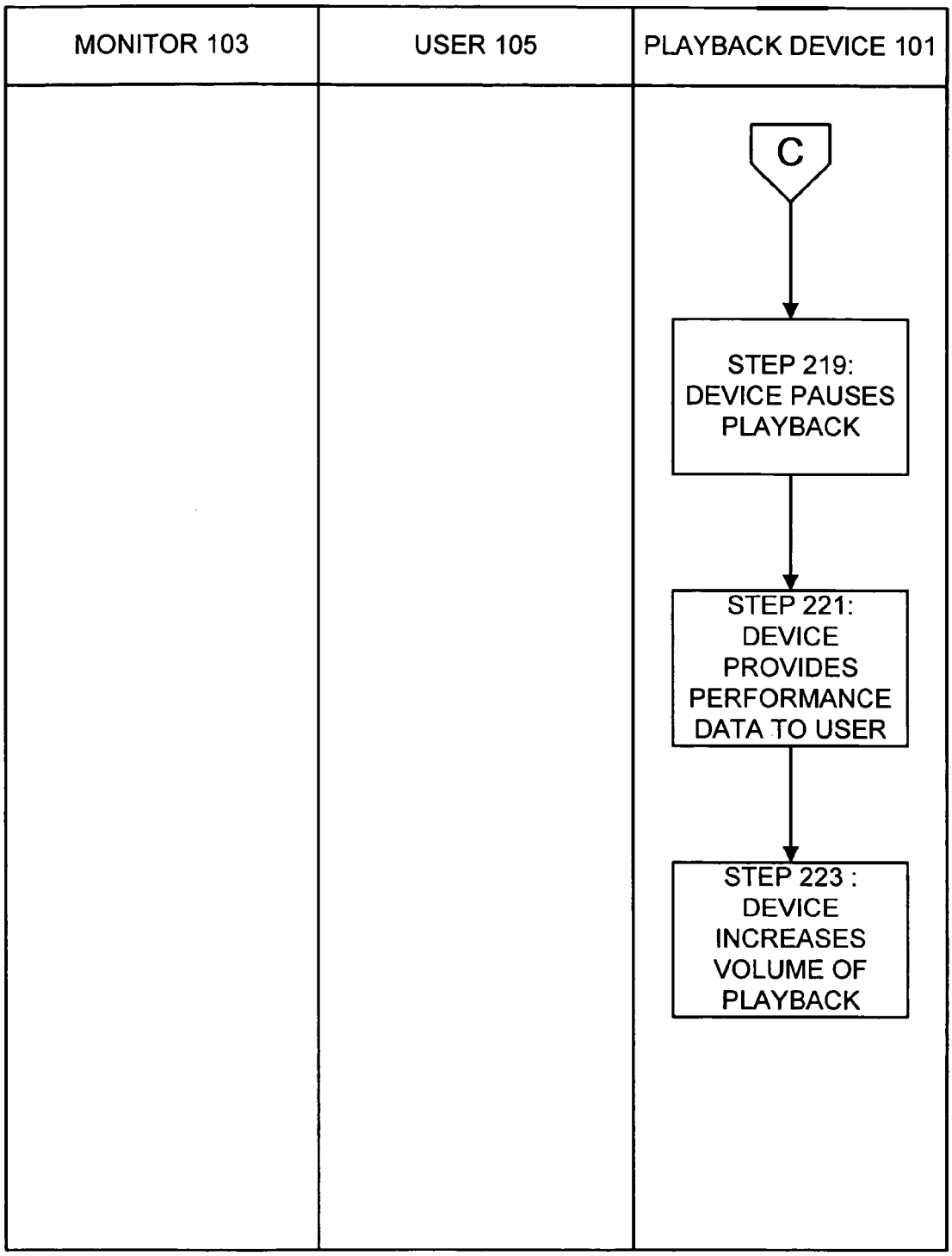

The operation of an audible playback device 101 according to various embodiments of the invention will now be described with reference to FIGS. 2A-2D. Referring now to FIG. 2A in step 201 the user first positions the athletic performance monitor 103. For example, if the athletic performance monitor 103 is a pedometer, the user 105 may position the pedometer on one of the user's feet, so that the pedometer may accurately detect every other step taken by the user. Alternately or additionally, if the athletic performance monitor 103 includes a GPS positioning device, then the user may position an antenna for the GPS positioning device high on the user's body, such as on the user's shoulder or head. As previously mentioned, with some embodiments of the invention, the athletic performance monitor 103 may be incorporated into the audible playback device 101. With these embodiments, the user may omit step 201.

Next, in step 203, the user activates the athletic performance monitor 103. Again, if the athletic performance monitor 103 is incorporated into the audible playback device 101, this process may be as simple as depressing a command button on the audible playback device 101. For example, if the athletic performance monitor 103 is a chronometer, then the user 105 may initiate the operation of the chronometer simply by depressing the appropriate button on the audible playback device 101.

If the athletic performance monitor 103 is remotely located from the audible playback device 101, then the user 105 may need to initiate a communication channel between the athletic performance monitor 103 and the audible playback device 101 in step 205. Such a process may include, for example, activating the appropriate command buttons on both the athletic performance monitor 103 and the audible playback device 101 within a preset amount of time, so that the athletic performance monitor 103 recognizes signals from the audible playback device 101 and the audible playback device 101 correspondingly recognizes signals from the athletic performance monitor 103. This type of channel initialization process is well known, and thus will not be discussed in further detail.

In step 207, the athletic performance monitor 103 begins collecting athletic performance data. Then, in step 209, the user 105 selects the audible content to be played back by the audible content playback module 113. For example, if the audible content source module 107 is an MP3 player, then the user may actuate the necessary buttons or other controls on the audible playback device 101 to select which stored MP3 files are to be audibly played back to the user 105 through the audible content playback module 113. Similarly, if the audible content source 107 is a radio, then the user may actuate the necessary buttons or other controls to select the radio frequency channel that will be played back to the user 105 through the audible content playback module 113. Then, in step 211, the audible playback device 101 begins playing back the audible content selected in step 209.

In step 213, the athletic performance monitor 103 transmits athletic performance data to the athletic performance monitor interface 109. With some embodiments of the invention, the athletic performance monitor 103 may periodically transmit athletic performance data to the athletic performance monitor interface 109. With still other embodiments of the invention, however, the athletic performance monitor 103 may continuously transmit athletic performance data to the athletic performance monitor interface 109. Still further, with some embodiments of the invention, the athletic performance monitor 103 may additionally or alternately provide athletic performance data to the athletic performance monitor interface 109 upon prompting by the user 105. Correspondingly, in step 215, the audible playback device 101 receives the athletic performance data from the athletic performance monitor 103 through the athletic performance monitor interface 109.

After receiving the athletic performance data from the athletic performance monitor 103, the audible playback device 101 determines when the athletic performance data is provided to the user 105 through the athletic performance user interface 115. For example, with some embodiments of the invention, the audible playback device 101 may periodically provide the user with the received athletic performance data at preset intervals (such as, for example, every five minutes, every mile or one-half mile of travel, etc.). Alternately or additionally, the audible playback device 101 may provide the user 105 with the received athletic performance data when the audible playback device 101 receives the performance data from the athletic performance monitor 103. Still further, with various embodiments of the invention, the audible playback device 101 may alternately or additionally provide the user 105 with received performance data when the user actively requests the performance data by, for example, actuating a button or other control to receive the performance data.

When the audible playback device 101 determines that the athletic performance data should be provided to the user 105, the audible playback device 101 reduces the volume of the audible content playback in step 217. Next, in step 219, the audible playback device 101 pauses playback of the audible content. Thus, the audible playback device 101 gradually reduces the volume of the audible content before providing the user 105 with the performance data. It should be appreciated, however, that various embodiments of the invention may instead immediately pause or stop playback of the audible content without previously decreasing its volume.

Next, in step 221, the audible playback device 101 provides the user with the received performance data. With some embodiments of the invention, the audible playback device 101 may visibly display the performance data received from the athletic performance monitor 103. For example, the audible playback device 101 may include a display, such as a liquid crystal display or color transistor display, for displaying the received performance data. With various embodiments of the invention where the performance data is only visually provided to the user, then the audible content playback module 113, may not reduce or pause playback of the audible content, but may instead continue to playback the audible content without interruption or interference.

With still other embodiments of the invention, however, the athletic performance user interface 115 may audibly relate the received athletic performance data to the user 105. For example, the athletic performance user interface 115 may include a voice synthesizer, which synthesizes voice information corresponding to the received performance data. With these embodiments, the audible playback device 101 increases the volume of the audible performance data provided to the user when at the volume of the audible content is reduced or paused, as described above.

Figure 3:
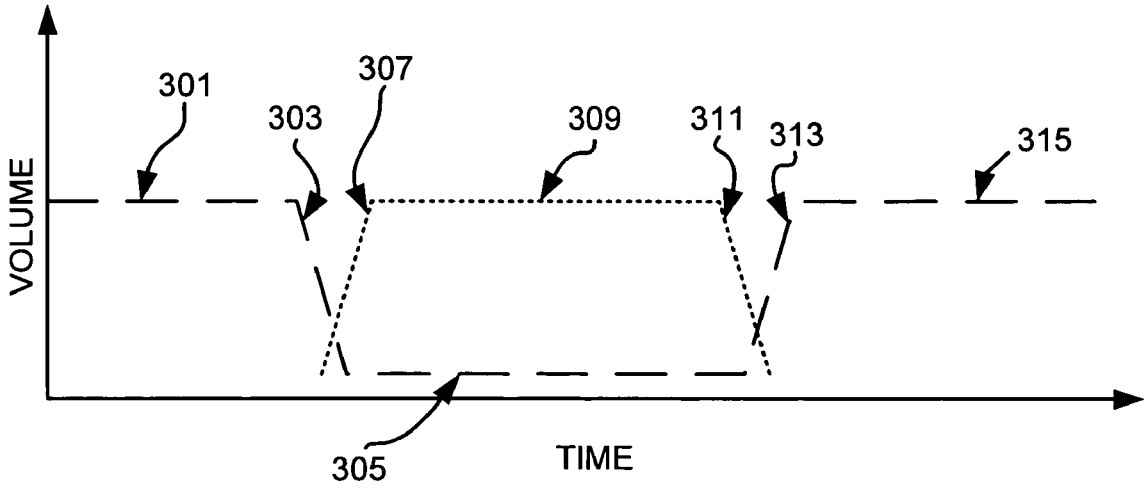
FIG. 3 illustrates one technique by which an audible content playback device according to various embodiments of the invention can reduce the volume of audible content to audibly provide performance data.

For example, FIG. 3 illustrates the initial volume of the playback of the audible content at 301. As previously noted, the audible playback device 101 reduces the volume of the audible content at 303 until the audible content is paused (or otherwise reduced to a level where it is only nominally audible to the user 105) at 305. Correspondingly, the audible playback device 101 increases the volume of the audible playback of the performance data at 307, until the volume of the audible playback of the performance data reaches a volume at 309 that may easily be heard by the user 105. After the performance data has been audibly played back for the user 105, the athletic performance user interface 115 decreases the volume of (or, alternately pauses the playback of) the performance data at 311. The audible content playback module 113 then correspondingly increases the volume of the audible content at 313 (or, alternately, restarts the playback of the audible content), until the audible content returns to its normal level at 315.

In this manner, the user may conveniently receive both audible content and audible performance data information while engaging in an athletic activity. More particularly, the user 105 need not switch between separate devices to receive both the audible content and the audibly provided performance data.

CONCLUSION

There are any number of alternative combinations for the invention, which incorporate one or more elements from the specification, including the description, claims, and drawings, in various combinations or sub combinations. It will be apparent to those skilled in the relevant technology, in light of the present specification, that alternate combinations of aspects of the invention, either alone or in combination with one or more elements or steps defined herein, may be utilized as modifications or alterations of the invention or as part of the invention. It may be intended that the written description of the invention contained herein covers all such modifications and alterations. For instance, in various embodiments, a certain order to various processes has been shown. However, any desirable reordering of the steps of these processes is encompassed by the present invention. Also, where certain units of properties such as size (e.g., in bytes or bits) are used, any other units are also envisioned.

What is claimed is:

1. A method of providing training information with audible content, comprising:

playing audible content at a first volume at an audio playback device;

receiving training information from an athletic performance monitor different from the audio playback device at a first preset interval, wherein the athletic training information received from the athletic performance monitor includes at least one measure of athletic activity;

pausing, at the audio playback device, playing of the audible content at a second preset interval;

providing, by the audio playback device, a user with the received training information at the second preset interval; and after providing the user with the received training information, resuming playing of the audible content at the audio playback device.

2. The method recited in claim 1, further comprising, after receiving the training information, reducing playing of the audible content to a second volume lower than the first volume.

3. The method recited in claim 1, wherein the audible content is music.

4. The method recited in claim 3, wherein the audible content is music played back from a storage device of the audio playback device.

5. The method recited in claim 3, wherein the audible content is music played from a wireless transmission received at the audio playback device.

6. The method recited in claim 1, wherein the audible content is voice content.

7. The method recited in claim 6, wherein the audible content is voice content played back from a storage device.

8. The method recited in claim 6, wherein the audible content is voice content played from a wireless transmission.

9. The method recited in claim 1, further comprising providing the training information by audibly playing the training information.

10. The method recited in claim 1, further comprising providing the training information by visually displaying the training information.

11. The method recited in claim 1, wherein the training information includes biometric information for a user.

12. The method recited in claim 1, wherein the training information includes positional information.

13. The method recited in claim 1, wherein the training information includes temporal information.

14. An audible playback device, comprising:

an athletic performance monitor interface to receive athletic performance information for a user from an athletic performance monitor at a first preset interval, wherein the athletic performance monitor is different from the audible playback device;

an athletic performance user interface to provide the received athletic performance information to the user at a second preset interval different from the first preset interval; and an audible content playback module to play audible content to the user.

15. The audible playback device recited in claim 14, further comprising an athletic performance data storage for storing the received athletic performance information.

16. The audible playback device recited in claim 14, wherein the audible playback device is a wireless telephone.

17. The audible playback device recited in claim 14, wherein the audible playback device is an electronic file music player.

18. The audible playback device recited in claim 14, wherein the audible playback device is an optical disc player.

19. The audible playback device recited in claim 14, wherein the athletic performance user interface control received athletic performance information that is visually provided to the user.

20. The audible playback device recited in claim 14, wherein the athletic performance user interface control received athletic performance information that is audibly provided to the user.

21. The method recited in claim 1, the second preset interval further comprising a time interval, a distance of travel interval, or a combination thereof.

22. The audible playback device recited in claim 14, the second preset interval further comprising a time interval, a distance of travel interval, or a combination thereof.

23. A method of providing training information with audible content, comprising:

playing, by an audio playback device, audible content at a first volume;

receiving, at the audio playback device, training information from an athletic performance monitor separate from the audio playback device at a first preset interval;

pausing, at the audio playback device, playing of the audible content at a second preset interval different from the first preset interval;

providing, by the audio playback device, the received training information at the second preset interval to the user; and after providing the user with the received training information, resuming playing of the audible content by the audio playback device.

24. The method of claim 23, wherein the first preset interval is defined by a combination of a time interval and a distance of travel interval.

* * * * *